United States Patent [19]

Eisele et al.

[11] Patent Number: 4,647,087

[45] Date of Patent: Mar. 3, 1987

[54] CENTRAL LOCKING DEVICE FOR A PLURALITY OF CLOSEABLE OPENINGS IN THE BODY OF A MOTOR VEHICLE

[75] Inventors: Albert Eisele, Achern; Jürgen Hess, Baden-Baden; Erwin Krimmer, Plüderhausen, all of Fed. Rep. of Germany

[73] Assignee: Robert Bosch GmbH, Stuttgart, Fed. Rep. of Germany

[21] Appl. No.: 709,781

[22] Filed: Mar. 11, 1985

[30] Foreign Application Priority Data

Mar. 14, 1984 [DE] Fed. Rep. of Germany ..... 3409285

[51] Int. Cl.[4] ..... E05C 17/58

[52] U.S. Cl. ..... 292/45

[58] Field of Search ..... 70/264, 275, 434; 292/336.3, 201, 45

[56] References Cited

U.S. PATENT DOCUMENTS 3,357,215 12/1967 Riester et al. ..... 70/264

3,785,187 1/1974 Wolz ..... 70/264

4,466,263 8/1984 Rathmann ..... 70/275 X 4,541,258 9/1985 Périou et al. ..... 70/275 X

*Primary Examiner*—Richard E. Moore

*Attorney, Agent, or Firm*—Michael J. Striker

[57] ABSTRACT

A central locking system for use in a motor vehicle includes a pressure source generating preferably an under pressure and an over pressure. The source is connected to a series of pneumatic control units each including a pressure chamber, a control element arranged in the chamber for movement between two control positions, an opening in the chamber communicating with a space enclosing a valve which normally closes the opening and the space being provided with a discharging nipple which is coupled via the subsequent series connected control units to an indicator device. The indicator device is arranged in the field of view of the car operator. In this manner, the operating condition of locking devices which are outside of view of the operator can be reliably checked.

8 Claims, 3 Drawing Figures

CENTRAL LOCKING DEVICE FOR A PLURALITY OF CLOSEABLE OPENINGS IN THE BODY OF A MOTOR VEHICLE

BACKGROUND OF THE INVENTION

This invention relates to a central locking system for at least two closeable openings in the body of a motor vehicle, the system including a pressure source for selectively generating under pressure or over pressure, locking devices assigned to individual openings to be closed, a plurality of pneumatic control units each including a control element cooperating with a cooresponding locking device, each locking element moveable between two control positions, and said control units being connected to the source of under pressure or over pressure so as to move their control elements into one of the control positions depending on pressure level in the source.

A known central locking system of this kind includes a plurality of control units assigned to respective locking devices and being parallel connected to a common main conduit leading to the pressure source. If in such prior art locking systems the control elements are to be actuated which are located outside the field of vision of the operator of the motor vehicle, for example the control elements for the locks of storages or outer storing spaces on buses or for trunks of passenger cars, the corresponding locking devices after actuation of the central locking system must be checked whether the locking action actually took place. This check-out is necessary inasmuch for example a locking device associated with a sluggish control element may remain open.

SUMMARY OF THE INVENTION

It is therefore a general object of the present invention to overcome this disadvantage.

In particular, it is object of this invention to provide a central locking system of this kind which reliably indicates to the operator of the motor vehicle that all locking devices are in the desired working position, especially that the locking devices which are outside of his field of view are securely locked.

Another object of this invention is to provide such an indicating means which does not require expensive arrangement and installation.

In keeping with these objects and others which will become apparent hereafter, one feature of this invention resides in the provision of series connected control units which are coupled to an indicator in such a manner that even if only one of the control devices fail to bring its control element into a desired position, particularly the control elements which are outside the field of vision of the operator, the indicating means become effective.

In the preferred embodiment of this invention, each control unit has a pressure chamber connectable to the source of over pressure or under pressure, the control element being arranged for movement in the chamber, and cooperating with a valve which normally closes a discharge opening of the chamber, the control element being normally kept in a working position away from the valve and when an under pressure is developed in the chamber, it is moved to its other working position in which it opens the valve and the under pressure is applied to the indicating means. This arrangement of the control unit makes it possible to connect a plurality of control devices in series. This series connection of pneumatically actuated control units guarantees that only after the completion of the movement of the corresponding control element into the desired control position the pressure source is connected to the chamber of the subsequent control unit. Accordingly, when the indicating means are connected to the outlet of the last control unit which is most remote from the pressure source, the actuation of the indicating means guarantees that all control units and their control elements before the last control unit have been also correctly actuated.

The novel features which are considered as characteristic for the invention are set forth in particular in the appended claims. The invention itself however both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
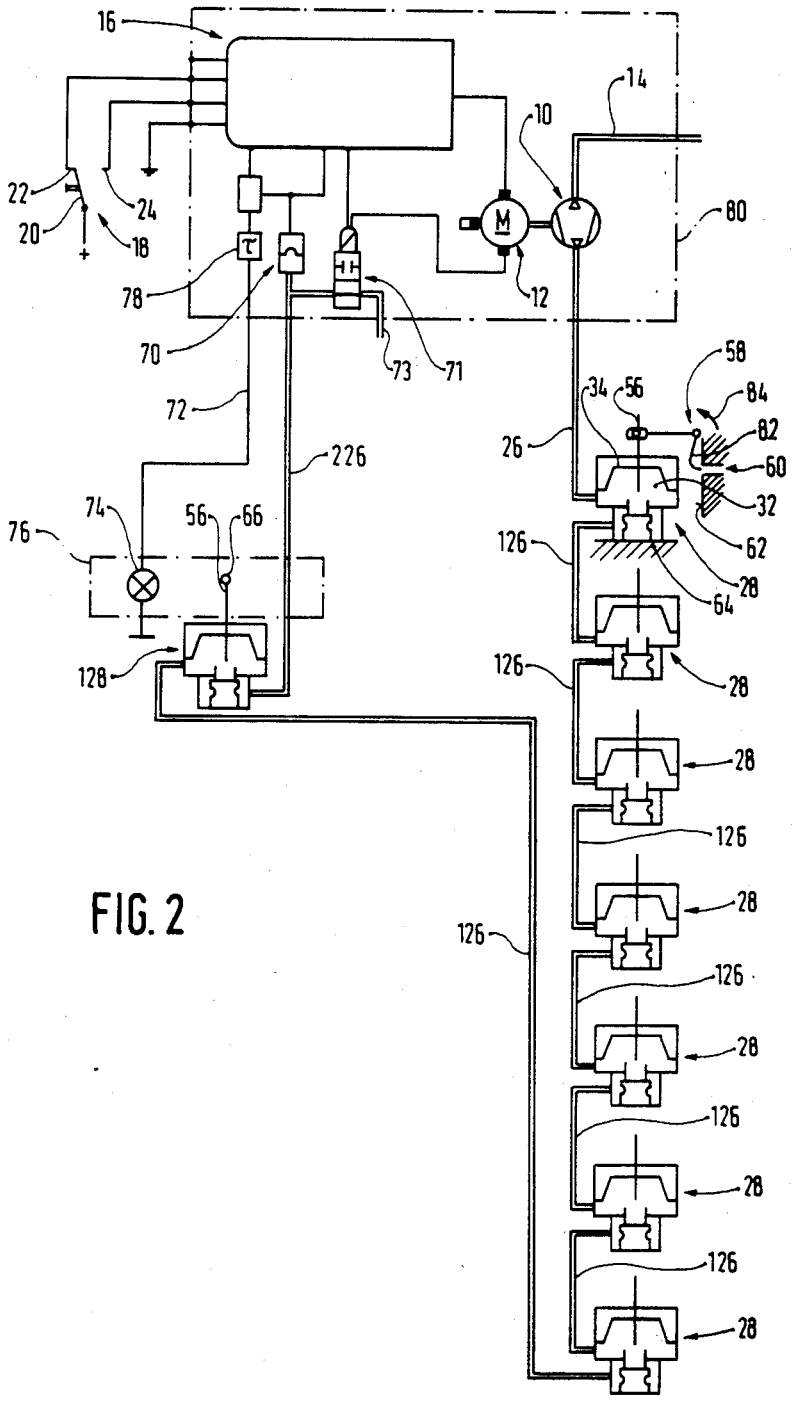
FIG. 2 is a schematic circuit diagram of an embodiment of the central locking system of this invention including the control units of FIG. 1.

Referring firstly to FIG. 2, the illustrated pneumatic system represents a central locking installation of a motor vehicle. It includes a pressure source in the form of a vane pump 10 which in this example is constructed as a bidirectional pressure pump. This bidirectional pressure pump 10 is driven by an electric motor 12. Depending on the direction of rotation of the motor, the pump 10 produces in the pneumatic system either under pressure or over pressure. In this example pressure medium is air. In this embodiment, the central locking system is brought into its closing condition when the vane type pump 10 produces under pressure. In doing so, air present in the pneumatic system is discharged through a connection pipe 14 into free atmosphere. The electric driving motor 12 is connected to the output of an electronic control circuit 16 whose inputs are coupled to respective door locks associated with the central locking system. The control inputs of the control circuit 16 are connected to switching contacts 22 and 24 of a key controlled door lock switch 18. Depending on the direction of rotation of the key, the switching member 20 of the switch 18 connects a control signal to one of the control inputs of the electronic control circuit 16, thus causing the driving motor to rotate either clockwise or counterclockwise and the vane pump 10 to generate suction or positive pressure.

As known, the bidirectional pressure pump 10 has two outlets of which one is connected to the connection pipe 14 while the other outlet is connected to a first section 26 of a working conduit leading to a first pneumatic control unit 28.

Figure 1:
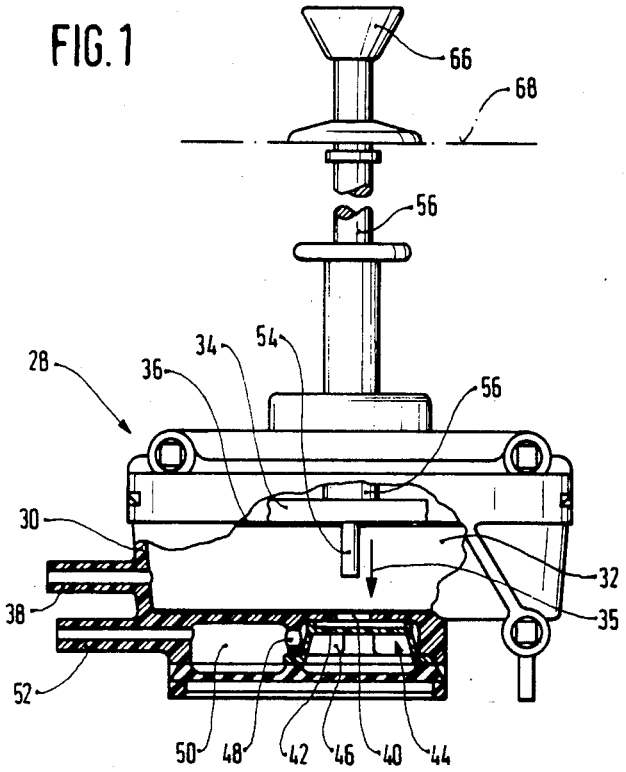
FIG. 1 is a side view, partly in section, of a pneumatic control unit pertaining to the central locking system of this invention.

The construction of the pneumatic control unit 28 is illustrated in FIG. 1. The control unit includes a housing 30 enclosing a chamber 32 in which a control element 34 is slideably supported for movement between two working positions. The control element 34 is secured to a diaphragm 36 forming the upper side of the chamber 32. A nipple 38 communicates laterally with the chamber 32 and is connected to section 26 of the working conduit (FIG. 2). The bottom side of the chamber 32 is provided with a connection opening 40 controlled by a closing member 42 of a valve 44 which is arranged opposite the outer surface of the bottom of the chamber 32. The closing member 42 of the valve 44 is normally biased into its closing position against the opening 40. The opening 40 communicates with a first space 46 which is connected via throttle 48 with a second space 50. The second space 50 is connected via a nipple 52 to a next section 126 of the working pressure conduit (FIG. 2). The lower surface of the control element 34 is provided with a projection 54 which cooperates through the opening 40 with the closing member 42. The opposite side of the control element 34 is connected to a push rod 56 (FIG. 1) to which a locking device 58 is linked. The locking device cooperates with a latch holding support 60 formed on a movable cover 62 on the car body. The control unit 28 is mounted in this embodiment on a part of the body which is fixed to the car frame 64. The tip of the push rod 56 is equipped with a control knob 66 (FIG. 1) which serves for manual operation of the corresponding locking device. The position of the control knob 66 simultaneously indicates whether the connected control element 34 is in a closing or opening position, thus indicating the operative condition of the corresponding locking device 58. The control knob 66 projects above the rim 68 (illustated by dash and dot line) of an opening for a nonillustrated car door. As shown in FIG. 2, all control units 28 pertaining to the central locking system are series connected by pneumatic conduit sections 26 and 126 connecting in series the nipples 38 and 52. In this manner, the working conduit sections 126 connect the nipple 52 of a control unit which is closer to the pressure source 10 with the nipple 38 of the subsequent control 28. The nipple 52 of the control unit 128 which is last in the row and most remote from the pressure source 10, is connected via a working conduit 226 to a pressure controlled electrical switch 70 which controls via the electronic circuit 16 the driving motor 12. The switch 70 also controls an indicator 74 which in this example is an optical indicator arranged in the field of vision of the operator of the motor vehicle. The indicator 74 is acutated when the operator actuates the door lock switch 18. A timing member 78 is arranged in the conductor 72 leading to the indicator 74 so that the latter is inactuated after a predetermined time period. The last section 226 of the pneumatic working conduits 26 and 126 is also branched before the pressure switch 70 to a venting valve 71 which is constructed as a two way directional solenoid controlled valve. The solenoid of the venting valve 71 is connected in series with the driving motor 12 and in the energized condition the venting valve 71 is open. The venting valve is closed independently on the rotational direction of the motor 12 when the motor is started, and is opened when the motor 12 is brought to a standstill. In this manner an instantaneous pressure equalization of the pneumatic system with the outer atmosphere is achieved through a pressure equalizing connection piece 73. The bidirectional pressure pump 10, the driving motor 12, the control circuit 16, the pressure acutated switch 70 and the timing member 78 are arranged in a common driving aggregate 80 which is connectable to the door lock switch 18, the indicator 74 and with the sections 26 and 226 of the pressure conduit.

The operation of the central pneumatic system of this invention is as follows: upon actuating the door lock switch 18 the control circuit 16 energizes the driving motor 12 which drives the vane type pump 10 in a direction in which air is sucked out of the working conduit 26. During the starting operation, the venting valve 71 is closed. In the chamber 32 of the first control unit 28 which is connected via the conduit section 26 to the pump 20, an under pressure is developed and the control element 34 is moved in the direction of arrow 35 (FIG. 1). The projection 54 on the control element 34 strikes against the closing member 42 of the valve 44 and uncovers the opening 40 so that spaces 46 and 50 are in communication with the chamber 32. Consequently, under pressure generated by the pump 10 is also produced via nipple 52 and the conduit section 126 in the chamber 32 of the series connected second control unit 28 whose control element 34 is actuated in the before described manner. In displacing the control element 34 in direction of arrow 35 the corresponding push rods 56 are also displaced in this direction and the locking element 82 of the associated locking device 58 is swung in the direction of arrow 84 into its closing position in which it engages the latch holding support 60 (FIG. 2). In this fashion all locking devices 58 are consecutively brought in their locking positions. After actuation of the last control unit 128 which is most remote from the pressure source 10, the under pressures reaches the last pressure conduit section 226 and switch 70 becomes actuated. As a consequence, the driving motor 12 and hence the pump 10 are deenergized and the indicator 74 is turned on and the solenoid valve 71 is opened. The operator of the motor vehicle now can see that all locking devices 58 are brought in the desired working condition. The indicator 74 after a time interval preset by the timing switch 78 is disconnected. Simultaneously control electronic circuit 16 is made ready for connecting, after the actuation of the switch 18, a signal to driving motor 12 for running in the opposite direction in which the pump 10 delivers over-pressure in the pneumatic system so that all control members are displaced in a direction opposite to arrow 35. After acutation of the last control unit 128 this open working condition of the locking devices is again signaled by the indicator 74 to the car operator.

The embodiment of this invention illustrated in FIG. 2 is used as a central locking system in a bus. The locking devices in this case pertain to stowages or storing spaces which in prior art embodiments must have been individually checked by the operator to make sure that after the actuation of the central control the locking devices are actually closed. In the locking system of this invention the indicator 74 and/or the position of the control knob 66 reliably indicates to the operator the actual condition of all locking devices. In another embodiment, the indicator 74 can be also an acoustic alarm which need not be arranged in the field of vision of the operator.

In a passenger car, the central locking system includes six control units 28 assigned to a corresponding number of closeable openings in the car body. The condition of locking devices 58 for the four doors is recognizeable from the position of the control knobs 56 on the door rims. Accordingly, only the control units 128 which are associated with the trunk lock and with the fuel tank lock need be connected in series with a signal control unit 28 which is associated with a door opening. The car operator then recognizes from the position of the control knob of this door whether the trunk lid and the tank flap are also locked.

When it is desired to open all locking devices 58 then the bidirectional pump 10 is operated to generate over pressure in the pneumatic system. As mentioned before, the control elements 34 are consecutively displaced opposite the arrow 35 (FIG. 1). At first, the closing member 42 of the valve 44 does not follow the upward movement of the assigned control element 34 inasmuch it is held in its present open position by the incoming over pressure. Only after all control elements in the series are displaced and the motor 10 with the pump 10 are deenergized by the pressure switch 70, the valves 44 close the corresponding openings 40. Due to the consecutive return movements of the control elements, all locking devices 58 disengage their holding supports 60 in the closure members and consequently all openings in the car body are unlocked. In this mode of operation, the pump 10 sucks outer air through the connection piece 14 and compresses the air in the pneumatic system.

Figure 3:
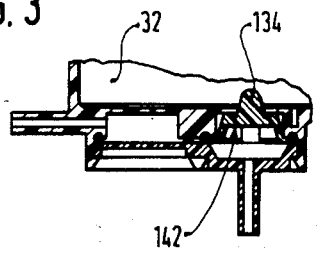
FIG. 3 is a sectional side view of a cutaway part of a modified version of a control unit of this invention.

FIG. 3 illustrates a modification in which the projection 54 on the control element 34 is substituted by a nose 134 on a closing member 142 of the valve 44. In both embodiments the displacement of the control element in the direction of arrow 35 opens the opening 40.

It is evident that the pneumatic system of this invention can be also operated in reverse order so that for closing the locking devices 58 air is compressed in the pneumatic system and only for the opening of the locks the pressure is sucked out from the system.

It will be understood that each of the elements described above, or two or more together, may also find a useful application in other types of constructions differing from the types described above.

While the invention has been illustrated and described as embodied in a specific example of a center locking system for motor vehicles, it is not intended to be limited to the details shown since various modifications and structural changes may be made without departing any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and is desired to be protected by Letters Patent is set forth in the appended claims:

1. A central locking system arranged in a motor vehicle to lock covers of a plurality of closeable openings in the vehicle, comprising means for selectively generating underpressure or overpressure; a plurality of locking devices assigned to respective covers; a plurality of pneumatic control units each including a chamber having a movable wall and an opposite fixed wall, a control element attached to said movable wall, said element being movable between two control positions and being linked to an assigned locking device, said fixed wall being formed with a space communicating with said chamber via a connection opening, a valve arranged in said space and including a closing member normally closing said connection opening; means for holding said closing member in its open position when said control element is displaced from one of its control positions; conduit sections connecting the chamber of a first control unit with said underpressure or overpressure generating means and further connecting the space of a preceding control unit with the chamber of a subsequent control unit to apply underpressure or overpressure into respective chambers whereby said control elements are moved into one of said control positions; and indicating means coupled to the valve of the last control unit to indicate positions of the control elements which are outside the field of vision of the operator of the motor vehicle.

2. A central locking system as defined in claim 1, wherein said indicating means include a pressure switch which controls an indicator.

3. A central locking system as defined in claim 2, wherein said indicator is an optical indicator arranged in the field of vision.

4. A central locking system as defined in claim 3 comprising a timing switch connected to said indicator to disconnect the same after a predetermined time interval.

5. A central locking system as defined in claim 1, wherein said holding means includes a projection secured to said control element opposite said opening to hold the closing member of the valve in its open position.

6. A central locking system as defined in claim 1, wherein said holding means includes a projection arranged on said closing member of the valve opposite said opening to cooperate with said control element.

7. A central locking system as defined in claim 1, wherein the space enclosing the valve of the last control unit in the series connection is connected to a pressure controlling valve.

8. A central locking system as defined in claim 7, wherein said pressure controlling valve is a solenoid controlled directional control valve having a solenoid which is connected in series with an electric motor energizing said source of pressure, said solenoid displacing said valve into an open position in response to the turn-off of said electric motor, to equalize pressure in said last control unit with the outer atmosphere.

* * * * *